US006147043A

United States Patent [19]

Moeller et al.

[11] Patent Number: 6,147,043

[45] **Date of Patent: *Nov. 14, 2000**

[54] MACHINE DISHWASHING DETERGENTS WITH SILVER PROTECTION

[75] Inventors: Hinrich Moeller, Monheim; Helmut Blum, Duesseldorf; Christian Nitsch, Duesseldorf; Juergen Haerer, Duesseldorf, all of Germany

[73] Assignee: Henkel Kommanditgesellschaft Auf Aktien, Duesseldorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/007,474

[22] Filed: Jan. 15, 1998

[30] Foreign Application Priority Data

Jan. 15, 1997 [DE] Germany ..... 197 01 031

[51] Int. Cl.[7] ..... C11D 3/28; C11D 3/395

[52] U.S. Cl. ..... 510/220; 510/221; 510/223; 510/233; 510/286; 510/287; 510/302; 510/318; 510/335; 510/345; 510/367; 510/372; 510/379; 510/401; 510/500; 510/509; 510/514

[58] Field of Search ..... 510/220, 221, 510/223, 233, 286, 287, 302, 318, 335, 345, 367, 372, 379, 401, 500, 509, 514

[56] References Cited

U.S. PATENT DOCUMENTS

| | | | |
|---|---|---|---|
| 3,606,990 | 9/1971 | Gobert et al. | 8/111 |
| 4,298,568 | 11/1981 | Gerhardt et al. | 422/16 |
| 4,647,429 | 3/1987 | Penninger | 422/12 |
| 4,734,257 | 3/1988 | Penninger | 422/13 |
| 5,480,576 | 1/1996 | Gary et al. | 252/95 |

FOREIGN PATENT DOCUMENTS

| | | |
|---|---|---|
| 29 34 461 | 3/1981 | Germany . |
| 41 28 672 | 3/1993 | Germany . |
| 43 25 922 | 2/1995 | Germany . |
| 43 38 724 | 5/1995 | Germany . |
| 95/10588 | 4/1995 | WIPO . |
| WO95/10588 | 4/1995 | WIPO . |

OTHER PUBLICATIONS

SÖFW 119:794–808 (1993).

*Primary Examiner*—Yogendra Gupta
*Assistant Examiner*—Charles Boyer
*Attorney, Agent, or Firm*—Wayne C. Jaeschke; Glenn E. J. Murphy

[57] ABSTRACT

In machine dishwashing using low-alkaline detergents, the protection of silver was to be guaranteed. This was achieved by using 3-amino-5-alkyl-1,2,4-triazoles and salts thereof as silver protectors in machine dishwashing detergents. In addition, the dishwashing detergents may contain bleaching agents and builders.

12 Claims, No Drawings

MACHINE DISHWASHING DETERGENTS WITH SILVER PROTECTION

BACKGROUND OF THE INVENTION

1. Field of the Invention

This invention relates to the use of 3-amino-5-alkyl-1,2,4-triazoles as silver protectors in machine dishwashing detergents and to dishwashing detergents containing 3-amino-5-alkyl-1,2,4-triazoles as silver protectors.

2. Discussion of the Related Art

In recent years, low-alkaline machine dishwashing detergents have been available to an increasing extent. Apart from their many advantages, however, the often inadequate protection of silver afforded by these products is a major problem which has pre-occupied both developers and users. Various proposals have been put forward in the more recent patent literature as to how silver can be protected against tarnishing, discoloration, oxidation or other optical and material-related disadvantages.

Thus, redox-active inorganic and organic substances have been described as silver protectors for addition to the wash liquor as have substances which are deposited as a protective layer on the silver surface and special bleaching systems which attack the silver surface to a reduced extent.

One objective of the various developments has been to find substances which are effective in small quantities because this reduces costs.

The use of 3-amino-5-alkyl-1,2,4-triazoles as a corrosion inhibitor for non-ferrous metals is known from DE 29 34 461.

WO-A-95/10588 describes 1,2-N-azoles, preferably imidazole, benzimidazole, tetrazole, 5-aminotetrazole, 1,2,4-triazole, 3-amino-1,2,4-triazole, and histidine as silver protectors which are said to be effective in quantities of 0.05 to 10% by weight in low-alkaline machine dishwashing detergents.

However, neither of the documents cited above discloses the use of 3-amino-5-alkyl-1,2,4-triazoles or mixtures thereof as silver protectors effective in small quantities in machine dishwashing detergents, particularly in low-alkaline machine dishwashing detergents.

The problem addressed by the present invention was to provide a silver protector for machine dishwashing detergents which, in use, would not affect—or would even improve—the performance properties otherwise typical of machine dishwashing detergents, such as cleaning performance, adequate foaming capacity, easy handling and the like, and which would be effective in small quantities.

DESCRIPTION OF THE INVENTION

Accordingly, the present invention relates to the use of 3-amino-5-alkyl-1,2,4-triazoles as silver protectors in machine dishwashing detergents.

The present invention also relates to a machine dishwashing detergent which contains at least one builder, at least one bleaching compound and at least one compound selected from the group of 3-amino-5-alkyl-1,2,4-triazoles and mixtures thereof.

The present invention also relates to machine dishwashing processes which are characterized in that 3-amino-5-alkyl-1,2,4-triazoles and/or mixtures thereof are used to protect silver or silver-containing tableware.

Such processes include, for example, the manual or machine application of 3-amino-5-alkyl-1,2,4-triazoles or mixtures thereof or formulations containing 3-amino-5-alkyl-1,2,4-triazoles or mixtures thereof in the form of pastes, powders, melts, oils, films, solutions, aerosols, lyosols, vapors or foams before, during or after the dishwashing process.

3-Amino-5-alkyl-1,2,4-triazoles corresponding to general formula (I):

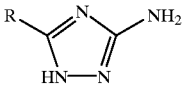

(I)

in which R is a linear or branched, saturated or unsaturated, optionally hydroxy- or alkoxy-substituted alkyl group containing 1 to 15 carbon atoms or an aryl, furyl, tetrahydrofuryl, thienyl, pyridyl, pyrrolidinyl, 5-oxo-2-pyrrolidinyl, pyrryl, imidazolyl or pyrimidyl group optionally substituted by hydroxy groups, primary, secondary or tertiary amino groups, alkoxy, alkylthio or thiol groups, and salts thereof with mineral acids, carbonic acid or organic carboxylic acids are particularly preferred for solving the problems addressed by the invention and have an excellent corrosion-inhibiting effect on silver. The same effect can also be found in particular in alkaline and low-alkaline hydroperoxide-containing machine dishwashing detergents.

Examples of the 3-amino-5-alkyl-1,2,4-triazoles suitable for use in accordance with the invention include those mentioned in the above-cited application, namely: 5,--propyl, -butyl-, -pentyl-, -heptyl-, -octyl-, -nonyl-, -decyl-, -undecyl-, -dodecyl-, -isononyl-, -versatic-10-acid alkyl-, -phenyl-, p-tolyl-, -(4-tert.butylphenyl)-, -(4-methoxyphenyl)-, -(2-, -3-, -4-pyridyl)-, -(2-thienyl)-, -(5-methyl-2-furyl)-, -(5-oxo-2-pyrrolidinyl)-, -3-amino-1,2,4-triazole.

Preferred acids for forming the salts are hydrochloric acid, sulfuric acid, phosphoric acid, carbonic acid, sulfurous acid, organic carboxylic acids, such as acetic acid, glycolic acid, citric acid, succinic acid.

The alkylamino-1,2,4-triazoles or physiologically compatible salts thereof are used in dishwashing detergents in a concentration of 0.001 to 10% by weight, preferably 0.0025 to 2% by weight and more preferably 0.01 to 0.04% by weight.

5-Pentyl-, 5-heptyl, 5-nonyl-, 5-undecyl-, 5-isononyl-, 5-versatic-10-acid alkyl-3-amino-1,2,4-triazoles and mixtures thereof are particularly effective.

Water-soluble and water-insoluble builders may be used in the detergents according to the invention, above all to bind calcium and magnesium. Water-soluble builders are preferred by virtue of their lesser tendency to form insoluble residues on dishes and hard surfaces. Typical builders which, according to the present invention, are present in quantities of preferably 5 to 90% by weight and more preferably 10 to 85% by weight, based on the detergent as a whole, are low molecular weight polycarboxylic acids and salts thereof, homopolymeric and copolymeric polycarboxylic acids and salts thereof, carbonates, phosphates and sodium and potassium silicates. Water-insoluble builders include zeolites, which may also be used, and mixtures of the builders mentioned above. Trisodium citrate and/or pentasodium tripolyphosphate and silicate builders from the class of alkali disilicates are preferably used for the detergents according to the invention.

Typical chlorine- and oxygen-containing bleaching compounds may be used in the detergents to solve the problem addressed by the invention. Oxygen-containing bleaching compounds are preferred and are present in the detergents according to the invention in quantities of preferably 1 to 35% by weight and more preferably 5 to 35% by weight. Typical inorganic oxygen bleaching agents are alkali metal perborates and hydrates thereof and alkali metal percarbonates. Sodium perborate (as the monohydrate or tetrahydrate) and sodium percarbonate are preferably used for the purposes of the invention.

Typical organic bleaching agents are diacylperoxides, for example dibenzoyl peroxide. Other typical organic bleaching agents are the peroxy-acids, for example alkyl peroxyacids and aryl peroxyacids. Preferred representatives are (a) peroxybenzoic acid and ring-substituted derivatives thereof, such as alkyl peroxygenzoicacids, and peroxy-α-naphthoic acid and magnesium monoperphthalate, (b) aliphatic or substituted aliphatic peroxy-acids, such as peroxylauric acid, peroxystearic acid, ε-phthalimidoperoxy-caproic acid, o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassilic acid, diperoxyphthalic acids, 2-decyl diperoxybutane-1,4-diacid, N,N-terephthaloyl-di-(6-aminocaproic acid).

Bleach activators may be present in the detergents used in accordance with the invention. Known bleach activators are compounds which contain one or more N-or O-acyl groups, such as compounds from the class of anhydrides, esters, imides and acylated imidazoles or oximes. Examples are tetraacetyl ethylenediamine (TAED), tetraacetyl methylenediamine (TAMD) and tetraacetyl hexylenediamine (TAHD) and also pentaacetyl glucose (PAG), 1,5-diacetyl-2,2-dioxohexahydro-1,3,5-triazine (DADHT) and isatoic anhydride (ISA). According to the invention, the bleach activators are used in quantities of 1 to 5% by weight, based on the detergent as a whole.

According to the invention, between 0 and 5% by weight of enzymes, based on the detergent as a whole, may be added to the detergent to improve its cleaning performance or to keep its cleaning performance consistent under relatively mild conditions. The most commonly used enzymes include lipases, amylases, cellulases and proteases. Preferred proteases are, for example BLAP® 140 (Biozym), Optimase®-M-400 and Opticlean®-M-250 (Solvay Enzymes); Maxacal®CX and Maxapem® or Esperase® (Gist Brocades) or even Savinase® (Novo). Particularly suitable cellulases and lipases are Celluzym® 0,7 T and Lipolase® 30 T (Novo Nordisk). The amylases used include, in particular, Termamyl® 60 T and Termamyl® 90 T (Novo), Amylase-LT® (Solvay Enzymes), or Maxamyl® P5000 (Gist-Brocades) and Purafect OxAm4000G® (Genecor). However, other enzymes may also be used.

Alkali carriers may be present as further components in quantities of up to 60% by weight and preferably in quantities of 10 to 40% by weight. Alkali carriers in the context of the invention are alkali metal hydroxides, alkali metal carbonates, alkali metal hydrogen carbonates, alkali metal sesqui carbonates, alkali metal silicates, alkali metal metasilicates and mixtures thereof. According to the invention, alkali metal carbonates are preferred, sodium carbonate, sodium hydrogen carbonate or sodium sesqui carbonate being particularly suitable.

Dishwashing detergents according to the invention may also contain other corrosion inhibitors to protect the tableware or the machine. The silver protectors described, for example, in DE 43 25 922, in DE 41 28 672 or DE 43 38 724 may even be used. According to documents in question, oxygen-containing and nitrogen-containing organic redox-active compounds, such as dihydric and trihydric phenols, for example hydroquinone, pyrocatechol, hydroxyhydroquinone, gallic acid, phloroglucinol, pyrogallol and derivatives of these compounds, are particularly useful. Salt-like and complex-like inorganic compounds, such as salts of the metals Mn, Ti, Zr, Hf, V, Co and Ce, are also commonly used. Zinc compounds may also be used to prevent corrosion of tableware.

If desired, surfactants preferably belonging to the class of nonionic surfactants may be used in quantities of up to 15% by weight, more particularly in quantities of 1 to 8% by weight and preferably in quantities of 2 to 5% by weight. Alkoxylated alcohols, alkyl polyglycosides, fatty acid hydroxylamides and block copolymers or ethylene oxide and propylene oxide are particularly preferred.

Alkoxylated alcohols are generally understood to be the reaction products of alkylene oxide, preferably ethylene oxide, with alcohols, relatively long-chain alcohols being preferred for the purposes of the invention. Depending on the reaction conditions, a complex mixture of addition products varying in their degrees of ethoxylation are generally formed from n moles of ethylene oxide and 1 mole of alcohol. Another embodiment consists in the use of mixtures of alkylene oxides, preferably a mixture of ethylene oxide and propylene oxide. If desired, compounds belonging to the class of "end-capped" alcohol ethoxylates, which may also be used in accordance with the invention, may be obtained by subsequent etherification with short-chain alkyl groups, preferably butyl groups. Highly ethoxylated fatty alcohols or mixtures thereof with end-capped fatty alcohol ethoxylates are most particularly preferred for the purposes of the invention. Where surfactants are used, it is important to ensure that the detergents have the required foaming behavior (generally low-foam).

Alkyl polyglycosides are surfactants which may be obtained by reaction of sugars and alcohols by the relevant methods of preparative organic chemistry. Depending on the process used, a mixture of monoalkylated, oligomeric or polymeric sugars is obtained. Preferred alkyl polyglycosides are alkyl polyglucosides. In a particularly preferred embodiment, the alcohol is a long-chain fatty alcohol or a mixture of long-chain fatty alcohols and the degree of oligomerization of the sugars is between 1 and 10.

Fatty acid polyhydroxylamides (glucamides) are acylated reaction products of the reductive amination of a sugar (glucose) with ammonia, the acylating agent used generally being a long-chain fatty acid, a long-chain fatty acid methyl ester or a long-chain fatty acid chloride. Secondary amides are obtained where the reduction is carried out with methylamine or ethylamine instead of ammonia, as described for example in SÖFW-Journal, 119, (1993), 794–808. Carbon chain lengths of $C_6$ to $C_{12}$ are preferably used in the fatty acid component.

The detergents according to the invention may also contain other ingredients typical of machine dishwashing detergents, such as foam inhibitors, dyes, lime soap dispersants, fluorides and the like.

EXAMPLES

Glass Beaker Tests

To carry out the test, 500 ml of Benrath water are introduced into a glass beaker and heated with stirring to 35° C. in a thermostat. After addition of 2.5 g of the dishwashing detergent (10/4 formulation), the temperature is increased to 65° C. (for 20 mins.±mins.) and the wash liquor is kept at that temperature for a total test duration of 30 minutes. After the treatment, the test spoon is rinsed with deionized water and visually examined:

0=no change (spoon satisfactory) (invention)

1=completely dull (but not discolored) surface (invention)

2=some patchy discoloration (black) (comparison)

3=moderate surface-covering discoloration

4=dark/violet discoloration over the entire surface

5=blackening (uniform to streaky)

The results obtained with the particularly effective $C_7/C_9$ alkyl derivative of the 3-amino-5-alkyl-1,2,4-triazole classified as effective are set out in the following Tables as Examples corresponding to the invention.

| | Test score on addition of inhibitor[1] | | | | |
|---|---|---|---|---|---|
| | 0.0025% | 0.005% | 0.01% | 0.025 | 0.04% |
| 3-Amino-5-alkyl-1,2,4-triazole | 3 | 0 | 0 | 0 | 0 |

| | Test score on addition of inhibitor[1] | | | |
|---|---|---|---|---|
| | 0.5% | 1% | 2% | 3% |
| 3-Amino-5-alkyl-1,2,4-triazole | 3 | 0 | 0 | 0 |

[1]Addition based on the detergent formulation

Further tests were carried out under dishwashing machine conditions; no tarnishing of silver (score 0) was observed.

What is claimed is:

1. A dishwashing detergent comprising:

(a) 10% to 90% by weight of a builder;

(b) 1% to 35% by weight of a bleaching compound; and (c) 0.001% to 0.04% by weight of a 3-amino-1,2,4-triazole of the formula I or mixture of 3-amino-1,2,4-triazoles of the formula I:

I

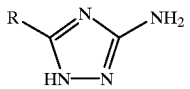

or a salt thereof with an organic or inorganic acid wherein the acid is selected from the group consisting of hydrochloric, sulfuric, phosphoric, carbonic, sulfurous, acetic, glycolic, citric, and succinic acids and mixtures thereof, R is selected from the group consisting of $C_1$ to $C_{15}$ linear or branched, saturated or unsaturated, optionally hydroxy- or alkoxy-substituted alkyl groups and optionally hydroxy-, alkoxy-, alkylthio-, thiol-, or 1°, 2°, or 3° amino-substituted aryl, furyl, tetrahydrofuryl, thienyl, pyridyl, pyrrolidinyl, 5-oxo-2-pyrrolidinyl, pyrryl, imidazolyl, and pyrimidyl groups.

2. A detergent according to claim 1, wherein R is selected from the group consisting of propyl, butyl, heptyl, octyl, nonyl, decyl, undecyl, dodecyl, isononyl, versatic-10-acid alkyl, phenyl, p-tolyl, 4-tert.butylphenyl, 4-methoxyphenyl, 2,3,4-pyridyl, 2-thienyl, 5-methyl-2-furyl, and 5-oxo-2-pyrrolidinyl.

3. A dishwashing detergent consisting essentially of:

(a) 10% to 90% by weight of a builder;

(b) 1% to 35% by weight of a bleaching compound; and (c) 0.001% to 0.04% by weight of a 2-amino-1,2,4-triazole or of the formula I mixture of3-amino-1,2,4-triazoles of the formula I:

I

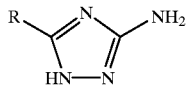

or a salt thereof with an organic or inorganic acid where the acid is selected from the group consisting of hydrochloric, sulfuric, phosphoric, carbonic, sulfurous, acetic, glycolic, citric, and succinic acids and mixtures thereof, R is selected from the group consisting of $C_1$ to $C_{15}$ linear or branched, saturated or unsaturated, optionally hydroxy- or alkoxy-substituted alkyl groups and hyroxy-, alkoxy-, alkylthio-, thiol-, or 1°, 2°, or3° amino-substituted aryl, furyl, tetrahydrofuryl, thienyl, pyridyl, pyrrolidinyl, 5-oxo-2-pyrrolidinyl, pyrryl, imidazolyl, and pyrimidyl groups.

4. A detergent according to claim 3, wherein the acid is selected from the group consisting of hydrochloric, sulfuric, phosphoric, carbonic, sulfurous, acetic, glycolic, citric, and succinic acids and mixtures thereof.

5. A detergent according to claim 3, wherein R is selected from the group consisting of propyl, butyl, heptyl, octyl, nonyl, decyl, undecyl, dodecyl, isononyl, versatic-10-acid alkyl, phenyl, p-tolyl, 4-tert.butylphenyl, 4-methoxyphenyl, 2,3,4-pyridyl, 2-thienyl, 5-methyl-2-furyl, and 5-oxo-2-pyrrolidinyl.

6. A detergent according to claim 3 consisting essentially of 0.0025% to 0.04% by weight of the 3-amino-1,2,4-triazole or mixture thereof.

7. A detergent according to claim 4 consisting essentially of 0.0025% to 0.04% by weight of the 3-amino-1,2,4-triazole or mixture thereof.

8. A detergent according to claim 4 consisting essentially of 0.01% to 0.04% by weight of the 3-amino-1,2,4-triazole or mixture thereof.

9. A detergent according to claim 5 consisting essentially of 0.0025% to 0.04% by weight of the 3-amino-1,2,4-triazole or mixture thereof.

10. A detergent according to claim 5 consisting essentially of 0.01% to0.04% by weight of the 3-amino-1,2,4-triazole or mixture thereof.

11. A method of protecting silver in a dishwashing process comprising contacting the silver with an amount of the composition of claim 9, said amount effective to inhibit tarnishing discoloration, oxidation, or other degradation of the silver.

12. A method according to claim 11, wherein R is selected from the group consisting of propyl, butyl, heptyl, octyl, nonyl, decyl, undecyl, dodecyl, isononyl, versatic-10-acid alkyl, phenyl, p-tolyl, 4-tert.butylphenyl, 4-methoxyphenyl, 2,3,4-pyridyl, 2-thienyl, 5-methyl-2-furyl, and 5-oxo-2-pyrrolidinyl.

* * * * *